US009757851B2

(12) United States Patent
Meinzer et al.

(10) Patent No.: US 9,757,851 B2
(45) **Date of Patent: *Sep. 12, 2017**

(54) OUTDOOR TOOL SYSTEM WITH INTERCHANGEABLE MODULAR HEADS

(71) Applicant: Redhed Tools, LLC, Cedar Hills, UT (US)

(72) Inventors: Richard Meinzer, Cedar Hills, UT (US); Jonathan Hart, Salt Lake City, UT (US)

(73) Assignee: Redhed Tools, LLC, Cedar Hills, UT (US)

( * ) Notice: Subject to any disclaimer, the term of this patent is extended or adjusted under 35 U.S.C. 154(b) by 1272 days.

This patent is subject to a terminal disclaimer.

(21) Appl. No.: 13/684,008

(22) Filed: Nov. 21, 2012

(65) Prior Publication Data

US 2014/0138280 A1 May 22, 2014

(51) Int. Cl.

| | |
|---|---|
| ***B25F 1/02*** | (2006.01) |
| ***B25G 1/04*** | (2006.01) |
| ***B25G 3/18*** | (2006.01) |
| ***B25G 3/26*** | (2006.01) |
| ***B25H 3/02*** | (2006.01) |

(52) U.S. Cl.

CPC ..... *B25F 1/02* (2013.01); *B25G 1/04* (2013.01); *B25G 3/18* (2013.01); *B25G 3/26* (2013.01); *B25H 3/02* (2013.01); *Y10T 29/49826* (2015.01); *Y10T 403/51* (2015.01)

(58) Field of Classification Search

CPC A01B 1/022; A01B 1/20; A01B 1/227; B25F 1/02; B25G 1/04; B25G 3/18; B25G 3/26; B25H 3/02; Y10T 29/49826; Y10T 403/51

USPC ..... 294/51, 57; 403/348, 349

See application file for complete search history.

(56) References Cited

U.S. PATENT DOCUMENTS

| | | | | | |
|---|---|---|---|---|---|
| 576,756 | A | | 2/1897 | Cole | |
| 810,987 | A | | 1/1906 | Spicer | |
| 1,464,353 | A | | 8/1923 | Crinella | |
| 1,515,820 | A | * | 11/1924 | Adelmann | A01B 1/022 294/51 |
| 1,530,225 | A | | 3/1925 | Belakoy | |
| 2,565,466 | A | * | 8/1951 | Barker | A01B 1/222 294/57 |
| 2,606,050 | A | * | 8/1952 | Morris | A01B 1/00 172/371 |
| 2,796,011 | A | | 6/1957 | Schmidt | |
| 4,030,150 | A | | 6/1977 | Fisher | |
| 4,162,132 | A | | 7/1979 | Kress et al. | |
| 4,476,939 | A | | 10/1984 | Wallace | |
| 4,700,420 | A | | 10/1987 | Belanger | |
| 4,786,095 | A | | 11/1988 | Dumont | |

(Continued)

*Primary Examiner* — Dean Kramer

(74) *Attorney, Agent, or Firm* — Morriss O'Bryant; Compagni Cannon, PLLC

(57) ABSTRACT

A multipurpose tool system that can be assembled into multiple configurations by a user. The tool system may comprise a plurality of components, including tool heads, shaft segments, and handle ends. The components of the tool system can be combined in various configurations to provide different functions, at different lengths. Connectors may be utilized to connect the various components of the system using a twist lock mechanism. The connectors may include a tubular sleeve member having a biased locking shaft that interacts with a locking groove.

44 Claims, 11 Drawing Sheets

(56) References Cited

U.S. PATENT DOCUMENTS

| | | | | | |
|---|---|---|---|---|---|
| 5,105,493 | A | | 4/1992 | Lugtenaar | |
| 5,226,718 | A | | 7/1993 | Lin | |
| 5,272,788 | A | | 12/1993 | Gilstrap | |
| 5,579,848 | A | * | 12/1996 | Hsu | A01B 1/222 16/422 |
| 5,799,996 | A | | 9/1998 | Fredrickson | |
| 5,915,482 | A | * | 6/1999 | Carruthers | A01B 1/227 172/375 |
| 5,957,516 | A | * | 9/1999 | Jacobs | A01B 1/02 294/57 |
| 6,126,359 | A | * | 10/2000 | Dittrich | A61B 17/29 403/325 |
| 6,669,397 | B1 | * | 12/2003 | Christion | B25G 3/00 15/105 |
| 6,925,686 | B2 | * | 8/2005 | Heathcock | B25G 1/04 15/144.4 |
| 7,219,382 | B2 | | 5/2007 | Johnson | |
| 8,002,491 | B2 | * | 8/2011 | Whitling | F16B 7/042 16/429 |
| 2010/0192738 | A1 | * | 8/2010 | Fenstemaker | B25F 1/00 81/489 |
| 2010/0215428 | A1 | * | 8/2010 | Trice | B25G 1/04 403/359.5 |

* cited by examiner 106A
120
104A
120
104B
120
102A
155
155
155
107

106A
120
104B
120
102A
155
155
107

120
120
102A
106B
155
104A
155
107

102A
106B
120
107

105
102A
107

OUTDOOR TOOL SYSTEM WITH INTERCHANGEABLE MODULAR HEADS

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND

1. The Field of the Present Disclosure

The present disclosure relates generally to tools, and more particularly, but not necessarily entirely, to modular hand tools.

2. Description of Related Art

Hand tools, such as shovels, rakes, and brooms, may comprise a handle attached to a tool head. A user may grasp and manipulate the handle of the hand tool to perform work using the tool head. The work performed by a tool head may include digging, scraping, raking, and sweeping. One drawback to some conventional hand tools is that they may be relatively large in size, making them difficult to store and transport. Another drawback is that purchasing multiple tools may be cost prohibitive, especially when the tools may only be used occasionally.

Some attempts have been made to overcome the aforementioned drawbacks. U.S. Pat. No. 5,799,996 (issued Sep. 1, 1998) discloses a multifunction hand tool that includes a handle assembly comprising a plurality of handle segments. The handle assembly is adapted for use with any one of a plurality of tool heads. U.S. Pat. No. 576,756 (issued Feb. 9, 1897) discloses a sectional tool handle adapted to various tools. The sectional tool handle includes sections of pipe or tube adapted to form the tool handle. U.S. Pat. No. 2,796,011 (issued Jun. 18, 1957) discloses a combination garden tools and sprinkler having multiple attachable tool heads.

While the devices disclosed in aforementioned patents are an improvement, additional solutions are still being sought. For example, the devices disclosed in aforementioned patents lack a certain robustness in design and quality that is often required by today's discriminating consumers. That is, the devices disclosed in aforementioned patents could be improved in both quality and design.

The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
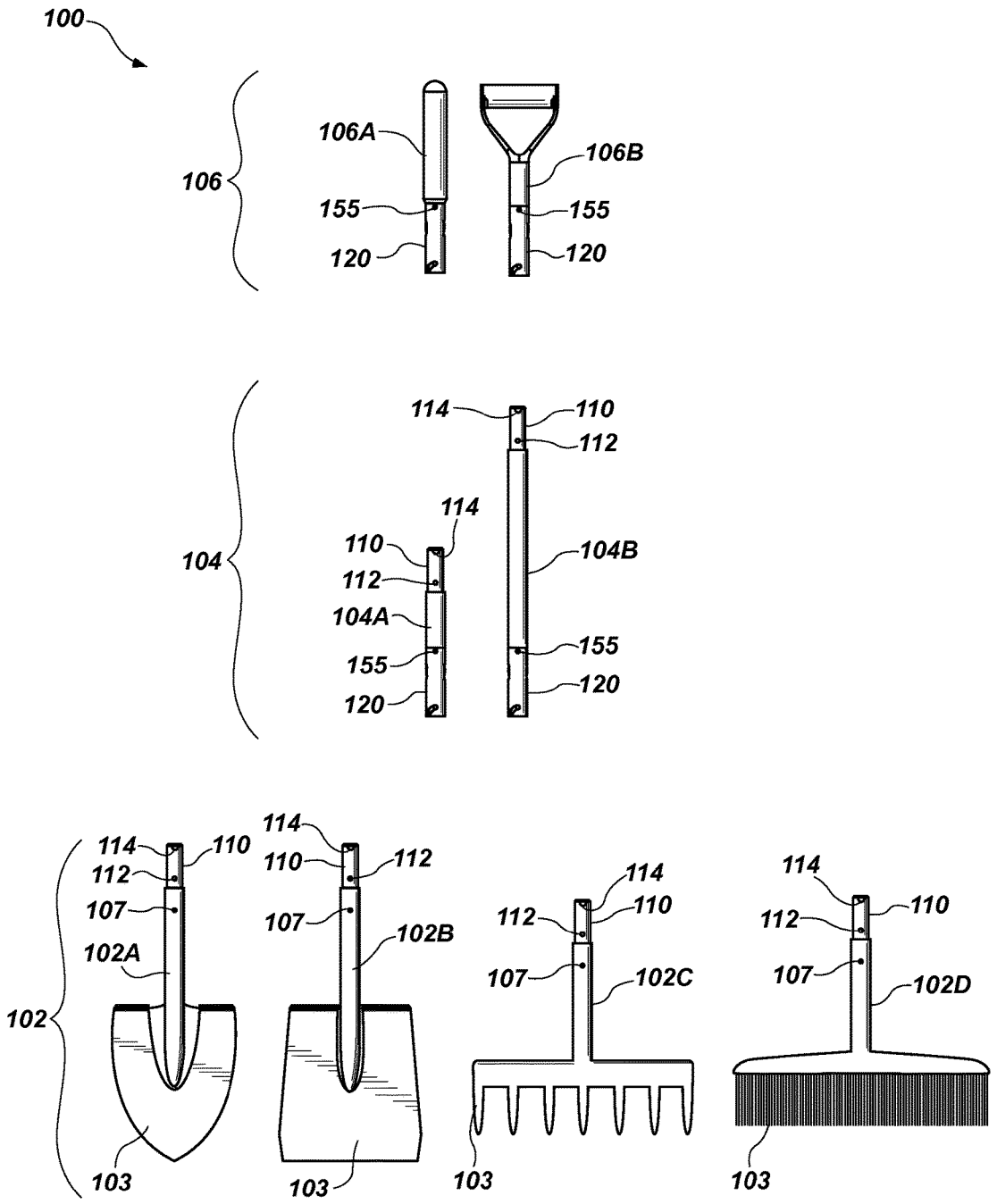
FIG. 1 depicts various components of an outdoor tool system according to an embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

In describing and claiming the present disclosure, the following terminology will be used in accordance with the definitions set out below.

It must be noted that, as used in this specification and the appended claims, the singular forms "a," "an," and "the" include plural referents unless the context clearly dictates otherwise.

As used herein, the terms "comprising," "including," "containing," "having," "characterized by," and grammatical equivalents thereof are inclusive or open-ended terms that do not exclude additional, unrecited elements or method steps.

Applicant has discovered a tool system with interchangeable modular heads. In an embodiment, the tool system may comprise a plurality of handle ends, a plurality of handle shaft segments, and a plurality of tool heads. A user may select any one of the handle ends, any one or more of the shaft segments, and any one of the plurality of tools to put together a customized tool configuration.

In an embodiment, connectors may connect different components of the tool system. The connectors may include a twist lock mechanism for locking different components of the system together. In an embodiment, the handle ends may include a grip, including a straight grip and a D grip. In an embodiment, the shaft segments may include shaft segments of different length. In an embodiment, the tool heads may comprise a spade shovel, a square shovel, a rake, and a broom. Each of the tool heads may have a different function or perform a different task.

The present disclosure may comprise a tool storage system for storing a modular tool system according to the present disclosure. In an embodiment, the tool storage system may comprise a carrying case having a plurality of storage locations for each of a plurality of tool heads, a plurality of shaft segments, and a plurality of handle ends. The tool storage system may provide a compact and easily portable case for the modular tool system disclosed herein.

In an embodiment, the present disclosure may provide a multipurpose tool system that can be assembled into multiple configurations. The tool system may comprise a plurality of components, including tool heads, shaft segments, and handle ends. The components of the tool system can be combined in various configurations to provide different functions, at different lengths. In an embodiment, connectors may be utilized to connect the various components using a twist lock mechanism.

Referring now to FIG. 1, there is depicted a multipurpose outdoor tool system 100 according to an embodiment of the present disclosure. The system 100 comprises components that may be combined in various combinations to provide different functions, at different lengths. The system 100 may comprise a plurality of tool heads 102, a plurality of shaft segments 104, and a plurality of handle ends 106.

Each of the tool heads 102 may comprise a tool head that is able to perform work, such as shoveling, raking, or sweeping. In an embodiment, the plurality of tools heads 102 comprises a spade shovel head 102A, a square shovel head 102B, a rake head 102C, a broom head 102D, a pick head (not shown) as known to those in the field of pick work, a leaf rake (not shown) as known to those in the field of leaf raking, a pitchfork head (not shown) as known to those in the field of pitchfork work, a pick axe head (not shown) as known to those in the field of pick axe work, a sledgehammer head (not shown) as known to those in the field of sledgehammer work, a snow shovel head (not shown) as known to those in the field of snow shoveling, a trenching shovel head (not shown) as known to those in the field of trench shoveling, any broom head as known to those in the field of sweeping or other broom work, a landscape rake (not shown) as known to those in the field of landscape raking, or any suitable tool head capable of performing desired work.

The spade shovel 102A may include an insertion tip 110 that is adapted to be installed into a connector as will be explained hereinafter. In an embodiment, the insertion tip 110 may be fastened to a metal working head 103 by a screw 107. The insertion tip 110 may include a pin 112 extending laterally therefrom. Disposed on a terminal end of the insertion tip 110 may be a locking groove 114. In an embodiment, the insertion tip 110 may be formed of wood, or some other sufficiently strong material, such as metal, fiberglass, or plastic. It will be appreciated that each of the other tool heads 102B, 102C and 102D may include an insertion tip 110, a pin 112, and a locking groove 114 as shown in FIG. 1.

Each of the plurality of shaft segments 104 may comprise connection features that allow the shaft segments 104 to connect to each other and the other components of the system 100. In an embodiment, the plurality of shaft segments 104 may comprise a first shaft segment 104A and a second shaft segment 104B. In an embodiment, the first shaft segment 104A and the second shaft segment 104B may be differing lengths. In an embodiment, the first shaft segment 104A and the second shaft segment 104B may be the same length. In an embodiment, the plurality of shaft segments 104 may comprise one or more other shaft segments (not shown) that may differ in length from the first shaft segment 104A and the second shaft segment 104B.

The shaft segment 104A may comprise an insertion tip 110, a pin 112, and a locking groove 114 on a first end. On a second end, opposite the first end, the shaft segment 104A may comprise a connector 120. As will be explained in more detail hereinafter, the connector 120 may be functional to connect the shaft segment 104A to other shaft segments or any one of the tool heads 102. The shaft segment 104B may also comprise an insertion tip 110, a pin 112, and a locking groove 114 on a first end and a connector 120 on a second end.

The plurality of handle ends 106 may comprise a straight grip 106A, or a handle end 106B, or any other suitable free end desired. In an embodiment, the plurality of handle ends 106 may comprise other grip types. The plurality of handle ends 106 may comprise a connection feature that allows the handle ends 106 to connect any one of the plurality of shaft segments 104 or any one of the plurality of tool heads 102. In particular, the straight grip 106A and the D grip 102B may each comprise a connector 120, which will be described in more detail hereafter.

Figures 2A, 2B, 2C, 2D, 2E:
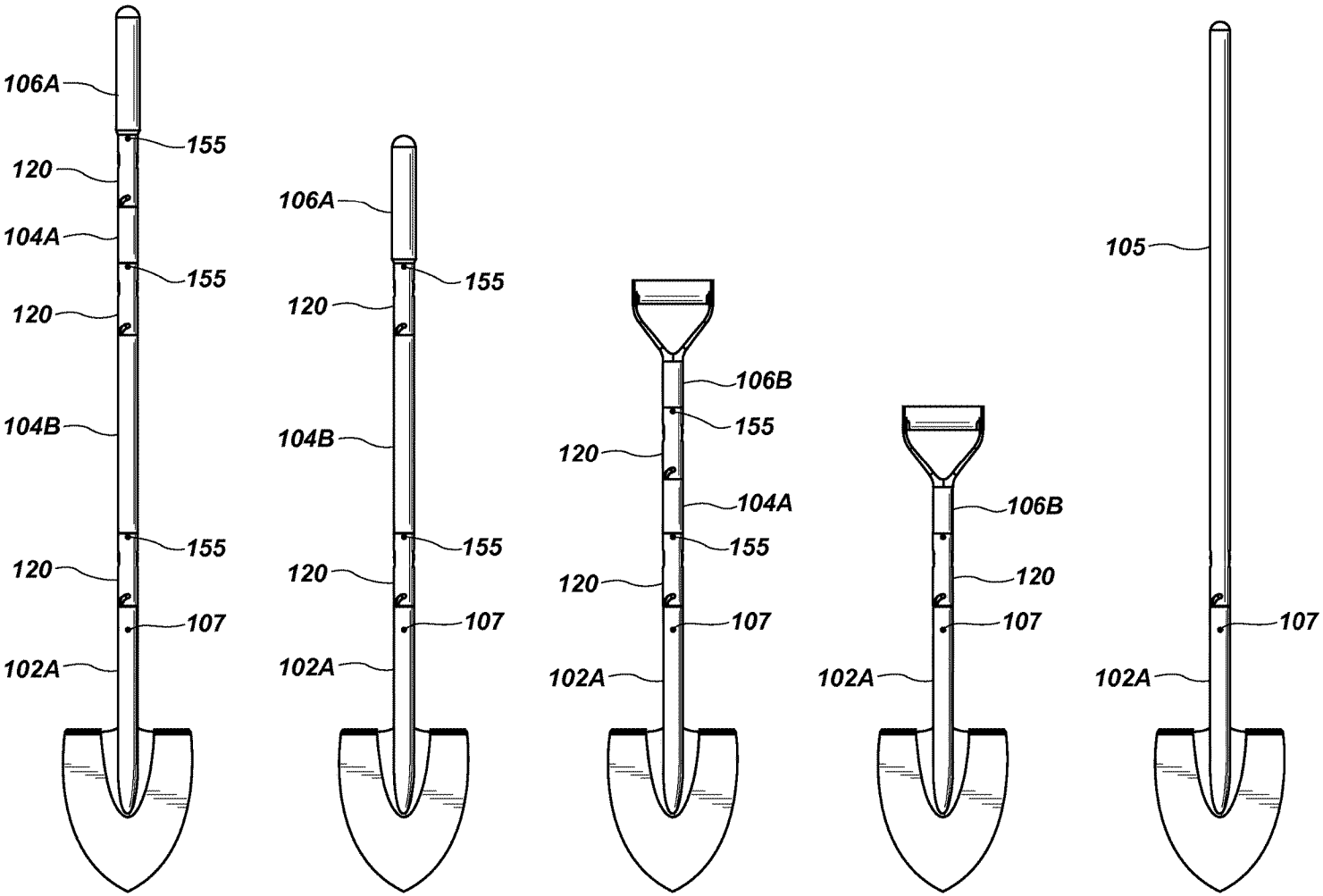
FIGS. 2A-2D depict exemplary configurations of the components of an outdoor tool system depicted in FIG. 1.
FIG. 2E depicts an exemplary embodiment of an outdoor tool system.

Referring now to FIGS. 2A-2D, there are depicted various exemplary combinations of the components of the system 100 according to an embodiment of the present disclosure. In FIG. 2A, the tool head 102A may be coupled to the shaft segment 104B. The shaft segment 104B which may be connected to the shaft segment 104A which may be connected to the handle end 106A. In FIG. 2B, the tool head 102A may be connected to shaft segment 104B which is connected to handle end 106A. In FIG. 2C, the tool head 102A may be connected to shaft segment 104A, which is connected to the handle end 106B. In FIG. 2D, the tool head 102A may be connected directly to handle end 106B.

It will be appreciated that the arrangement of components shown in FIGS. 2A-2D is exemplary, and that the components of the tool system 100 may be arranged in even more configurations than that shown in FIGS. 2A-2D. For example, the tool head 102A may be replaced with any other one of the tool heads 102B, 102C, and 102D. Further, it will be appreciated that the different components may be connected by connectors 120.

Referring now to FIG. 2E, there is depicted the tool head 102A mounted on a shaft segment 105. The shaft segment 105 may have an integrated connector 120. It is therefore to be understood that an embodiment of the present disclosure may include a single, one-piece, unitary shaft segment 105, to which a single tool head such as tool head 102A or any other suitable tool head, is removably attached, preferably but not necessarily by way of a connector 120 integrated within the shaft segment 105.

Figure 3A:
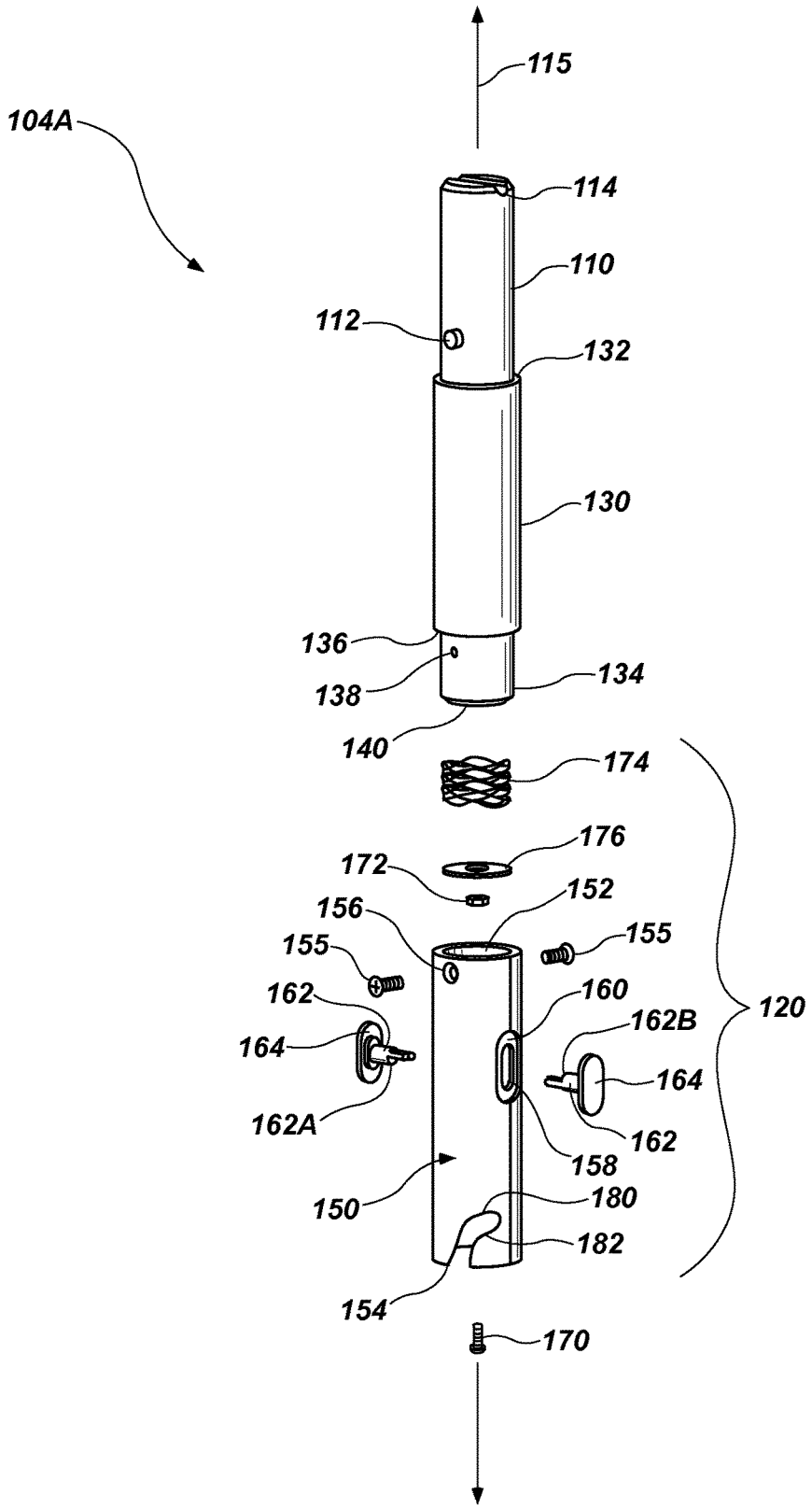
FIG. 3A depicts an exploded view of an exemplary shaft segment according to an embodiment of the present disclosure.

Referring now to FIG. 3A, there is depicted an exploded view of the shaft segment 104A. The shaft segment 104A may comprise a body portion 130. The insertion tip 110 may extend from the body portion 130. The insertion tip 110 may have a diameter smaller than the diameter of the body portion 130 to thereby form an annular rim 132. The locking groove 114 may be disposed in a terminal end of the insertion tip 110.

The pin 112 may extend laterally from a sidewall of the insertion tip 110 and perpendicular to a longitudinal axis 115 of the shaft segment 104A. Disposed on the end of the body member 130 opposite of the insertion tip 110 may be an insertion tip 134. The insertion tip 134 may have a diameter smaller than the diameter of the body member 130 to thereby form an annular rim 136.

The connector 120 may include a tubular sleeve member 150. The tubular sleeve member 150 may define a first socket 152 at a top end and a second socket 154 at a bottom end. The first socket 152 may be adapted to receive the insertion tip 134. Fasteners 155, such as screws, may secure the tubular sleeve member 150 to the insertion tip 134. In particular, the fasteners 155 may be inserted through bores 156 in the tubular sleeve member 150 and threaded into bores 138 in the insertion tip 134.

Elongated slots 158 may be formed in the tubular sleeve member 150. A locking shaft 162 may be formed from locking shaft segments 162A and 162B. In an embodiment, the locking shaft segments 162A and 162B may be joined by a fastener assembly that includes a threaded fastener 170 and a nut 172. In an embodiment, the locking shaft 162 may extend through an interior of the tubular sleeve member 150. The locking shaft 162 may be disposed in, and guided by, the elongated slots 158 such that the locking shaft 162 may move up and down in the slots 158.

A recessed portion 160 may surround each of the slots 158. The recessed portions 160 may be adapted to receive release buttons 164 disposed on the end of the locking shaft 162. In an embodiment, the release buttons 164 may be able to slide up and down in the recessed portions 160 in response to user input.

A biasing member 174 may be disposed in the tubular sleeve member 150 between a bottommost end 140 of the insert tip 134 and a washer 176. The biasing member 174 may bias the locking shaft 162 in the elongated slots 158. In an embodiment, the biasing member 174 is a wave spring. In an embodiment, the biasing member 174 may be any other resilient device.

Formed in the tubular sleeve member 150 may be a pin guide slot 180 for guiding the pin 112 of another one of the components. In an embodiment, the pin guide slot 180 may be curved. The pin guide slot 180 may include a cam surface 182 that forms a cam mechanism with the pin 112 of another one of the components. The cam mechanism may be operable to translate rotation of an insert tip 110 of another one of the components into a linear motion.

Figure 3B:
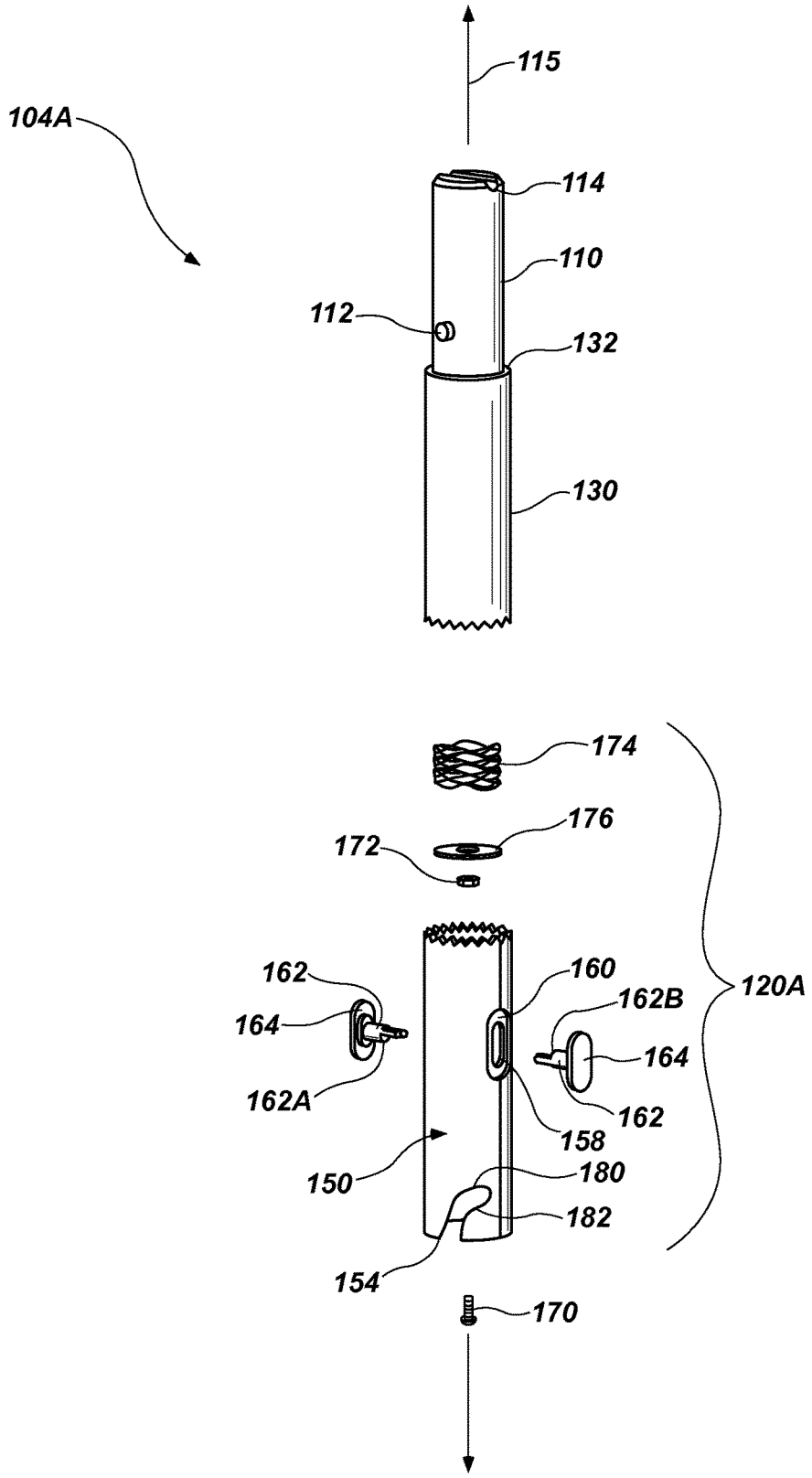
FIG. 3B depicts an exploded, fragmentary view of an exemplary shaft segment according to an embodiment of the present disclosure.

Referring now to FIG. 3B, there is depicted an exploded, fragmentary view of the shaft segment 104A of FIG. 3A, according to an embodiment of the present disclosure, where like reference numerals depict like components. The biasing member 174 may be biased against the locking shaft 162 by any suitable mechanism, including by the body member 130, or by an insert, or by a pin, or by a washer, or by a blocking member, or by a screw, or by a projection, or by a surface, or in some other manner, all of which fall within the scope of the present disclosure.

Figure 4:
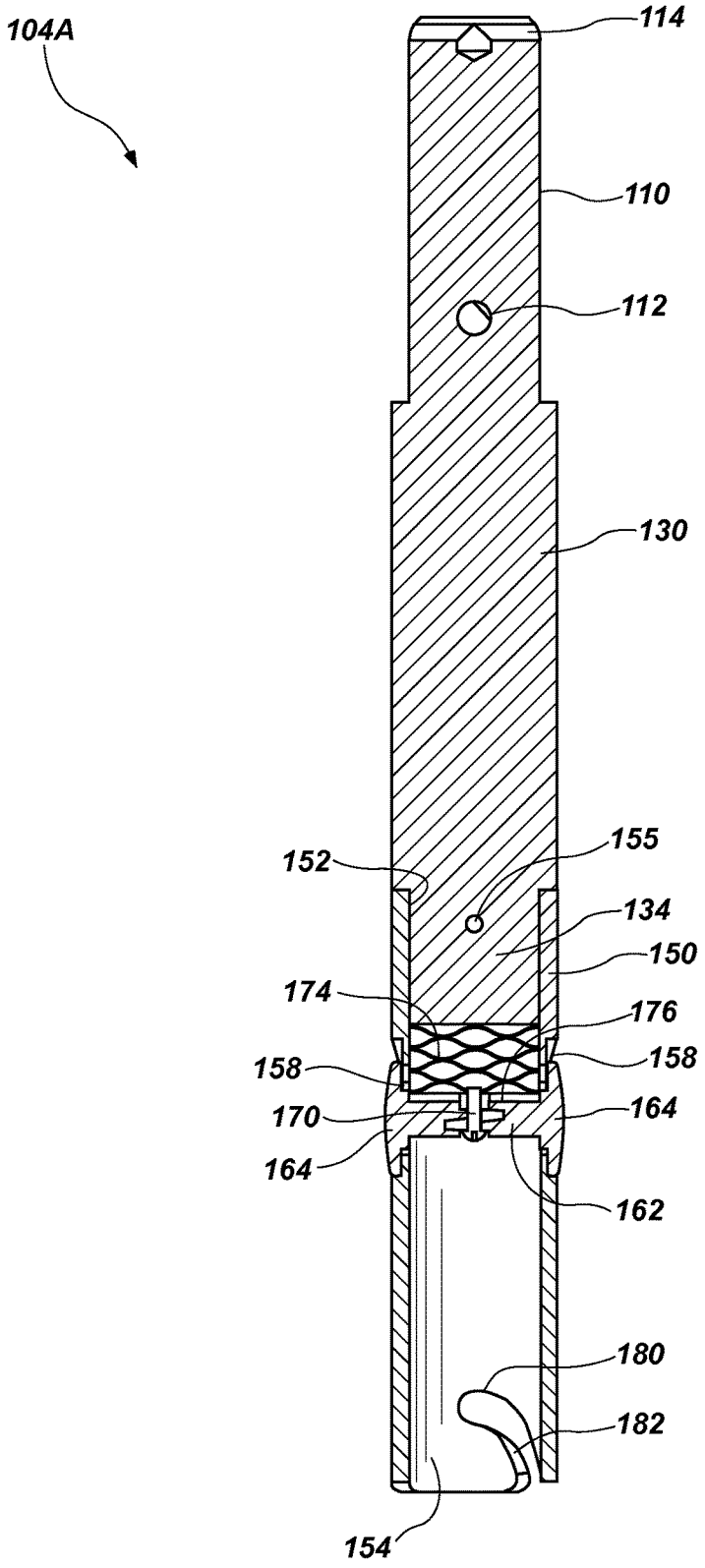
FIG. 4 is a cross-sectional view of the exemplary shaft segment shown in FIG. 3A.

Referring now to FIG. 4, where like reference numerals indicate like components, there is shown a cross-sectional view of the shaft segment 104A. As can be observed, the tip 134 of the body member 130 may be installed into the first socket 152 of the tubular sleeve member 150 and secured by the fasteners 155. The biasing member 174 may bias the washer 176 against the locking shaft 162 such that the locking shaft 162 is biased toward the opening of the second socket 154.

Figure 5C:
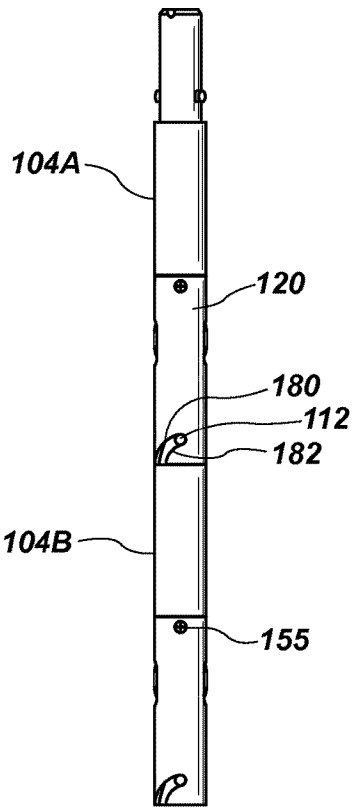
FIGS. 5A, 5B, and 5C depict an exemplary procedure for coupling a first shaft segment and a second shaft segment in an end-to-end configuration to form a handle assembly.
Figure 5B:
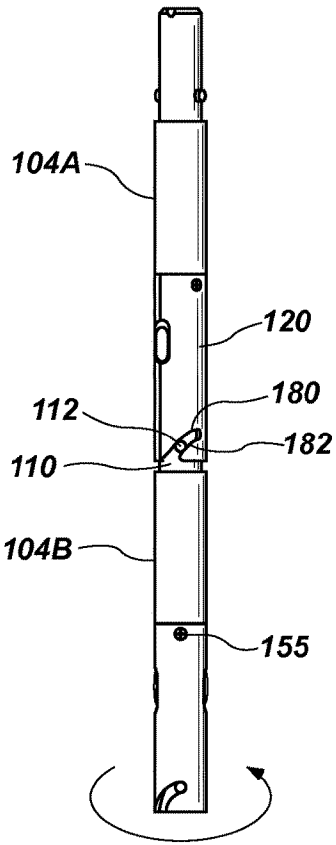
Figure 5A:
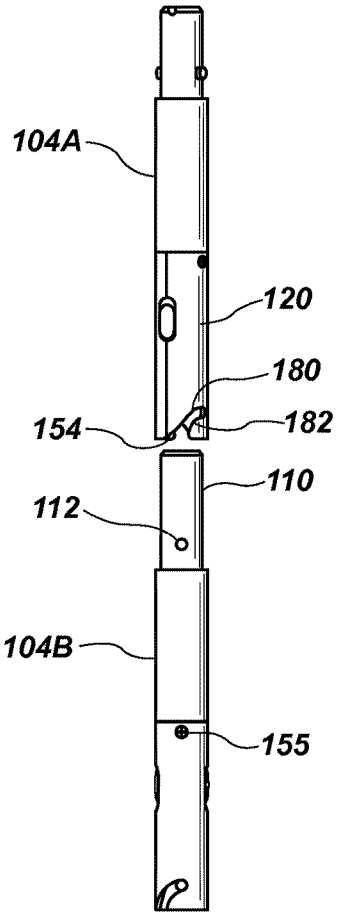

Referring now to FIGS. 5A-5C, there is shown a method of connecting the shaft segment 104A to the shaft segment 104B using the connector 120. As shown in FIG. 5A, the insertion tip 110 of the shaft segment 104B may be guided into the second socket 154 of the connector 120. The pin 112 of the shaft segment 104B may be guided into the pin guide slot 180.

As shown in FIG. 5B, the shaft segment 104B may be rotated such that the pin guide slot 180, and in particular, the cam surface 182, interacts with the pin 112 such that the rotational movement is translated into a linear movement to thereby force the insertion tip 110 deeper into the second socket 154. As shown in FIG. 5C, the pin 112 is disposed at the end of the pin guide slot 180 and the insertion tip 110 is fully installed into the second socket 154.

Figure 6:
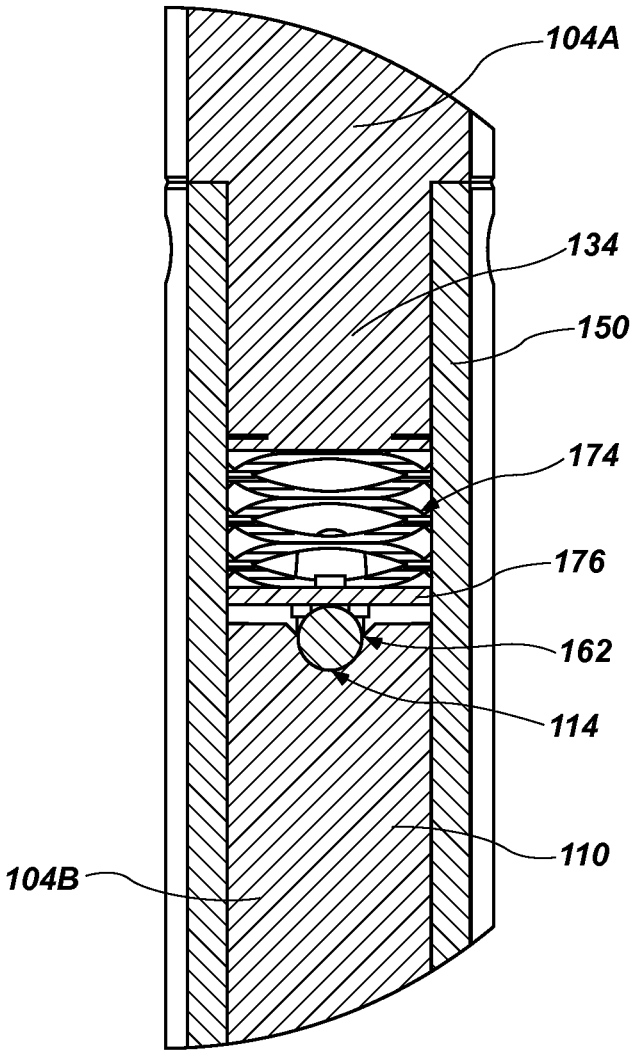
FIG. 6 is a fragmentary, cross-sectional view of a connection between a first shaft segment and a second shaft segment according to an embodiment of the present disclosure.

Referring now to FIGS. 5C and 6, as the pin 112 of the shaft segment 104B is rotated in the pin guide slot 180, the cam surface 182 guides the pin 112, and hence the insertion tip 110 of the shaft segment 104B, deeper into the second socket 154 such that the end of the insertion tip 110 may begin to push against the locking shaft 162. When the locking groove 114 on the end of the insertion tip 110 is in alignment with the locking shaft 162, the locking shaft 162 may be forced into the groove 114 by the biasing member 174 as shown in FIG. 6. The interaction of the locking shaft 162 and the locking groove 114 connect the shaft segments 104A and 104B end-to-end. It will be appreciated that the shaft segment 104B is shown in a "locked" position meaning that the locking shaft 162 is disposed in the locking groove 114. An "unlocked" position may be anytime the locking shaft 162 is not disposed in the locking groove 114.

Figure 7:
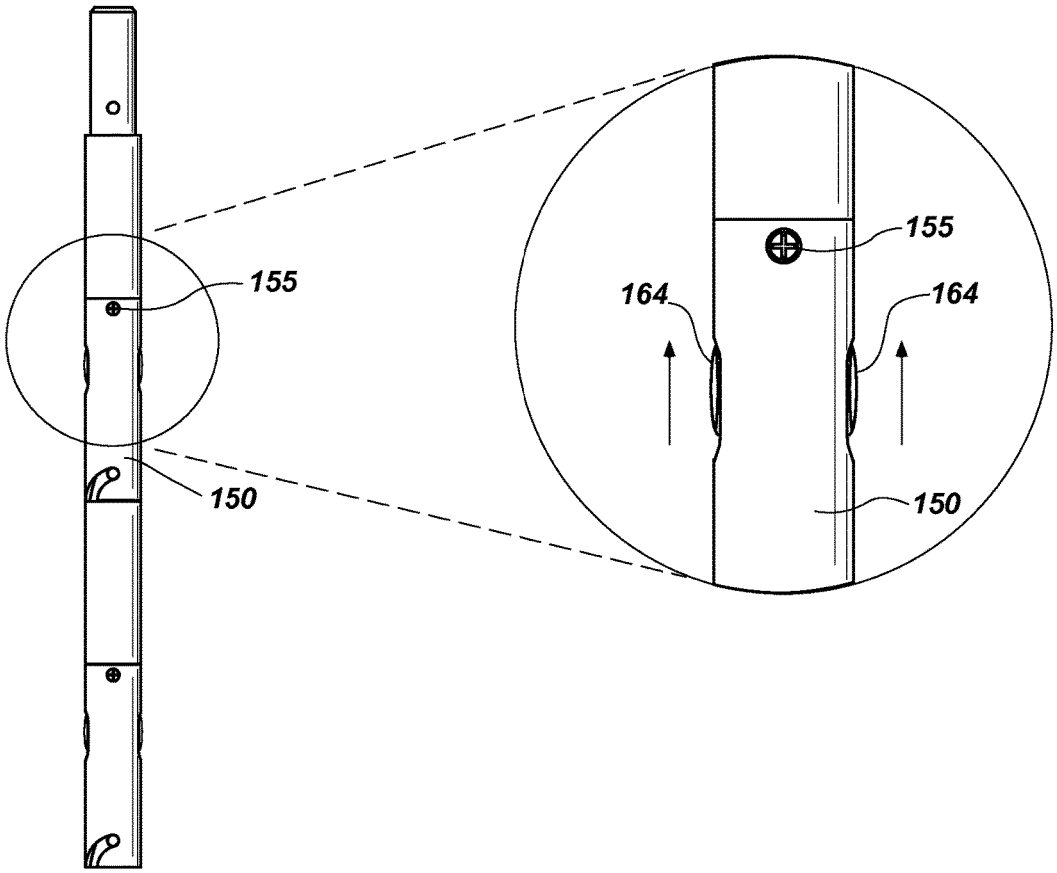
FIG. 7 depicts a manual release procedure to release a first shaft segment and a second shaft segment.

Referring now to FIGS. 5C, 6 and 7, to disconnect the shaft segment 104A and the shaft segment 104B, the locking shaft 162 may need to be released from the locking groove 114. In order to release the locking shaft 162, a user may slide buttons 164 upwards in the elongated slots 158 as shown in FIG. 7. This action may move the locking shaft 162 out of the locking groove 114 such that the shaft segments 104A and 104B may be disconnected by a rotational movement, opposite of that shown in FIGS. 5A-5C.

It will be appreciated that any of the components of the tool system 100 may be connected and disconnected to other components as described above in relation to FIGS. 5A-7.

Figure 8A:
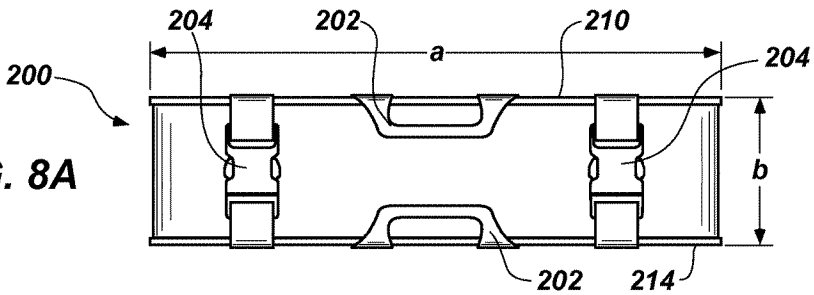
FIGS. 8A, 8B, 8C, and 8D depict a top view, a side view, an end view and a bottom view of a carrying case for the outdoor tool system shown in FIG. 1 according to an embodiment of the present disclosure.
Figure 8B:
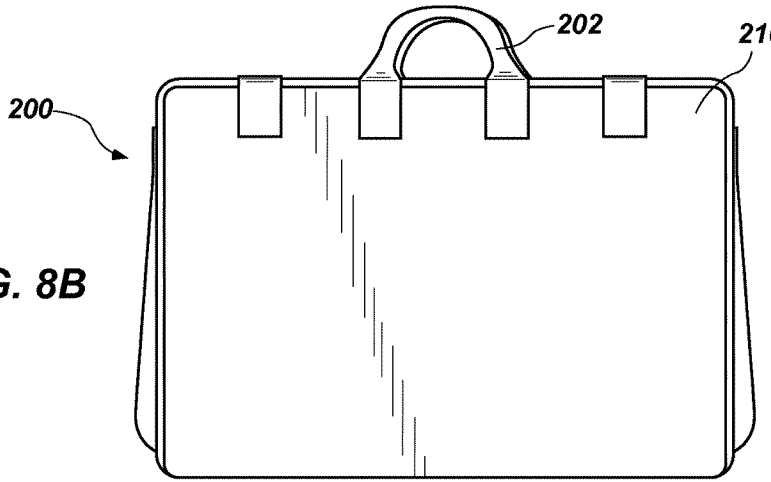
Figure 8C:
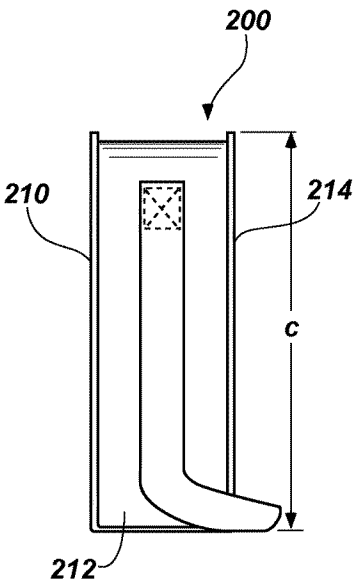
Figure 8D:
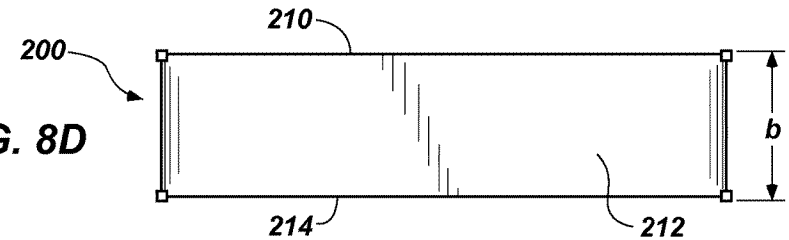
Figure 9:
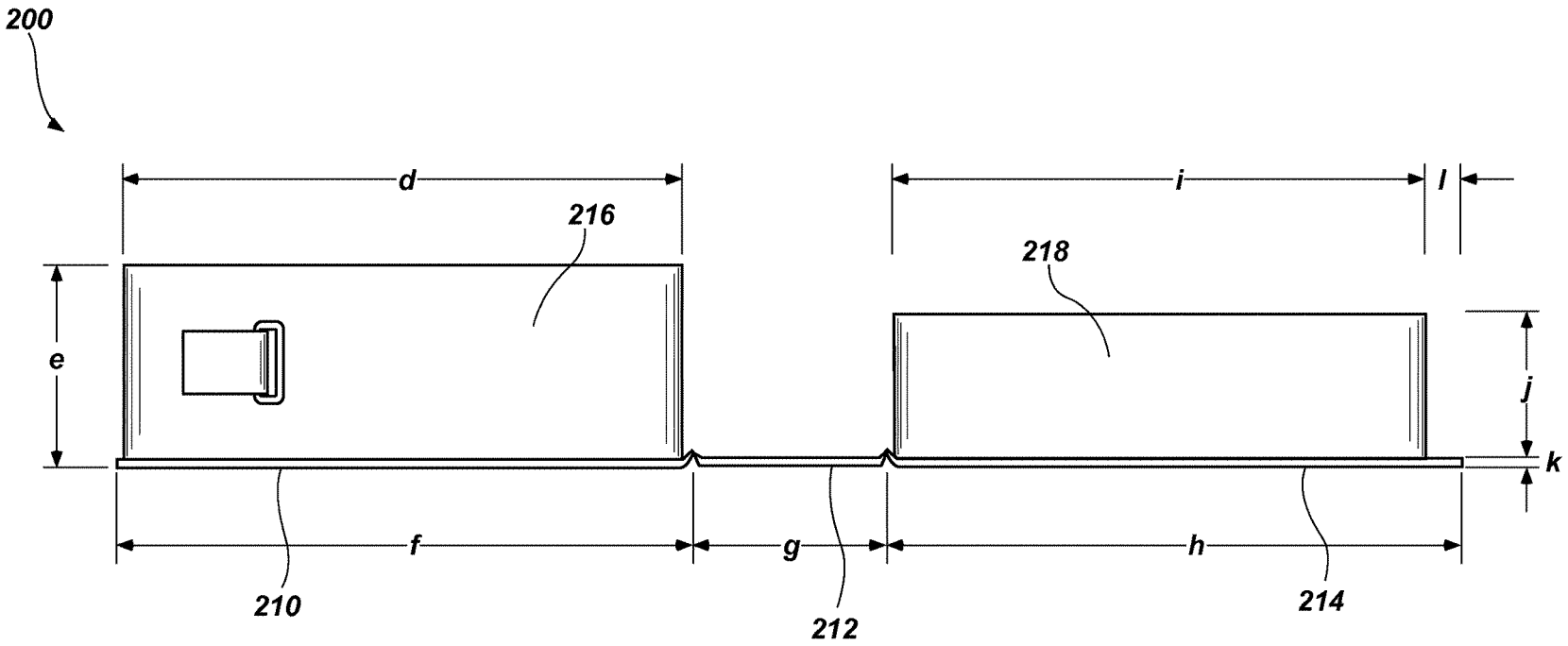
FIG. 9 is a side view of the carrying case shown in FIGS. 8A-8D in the open position.
Figure 10:
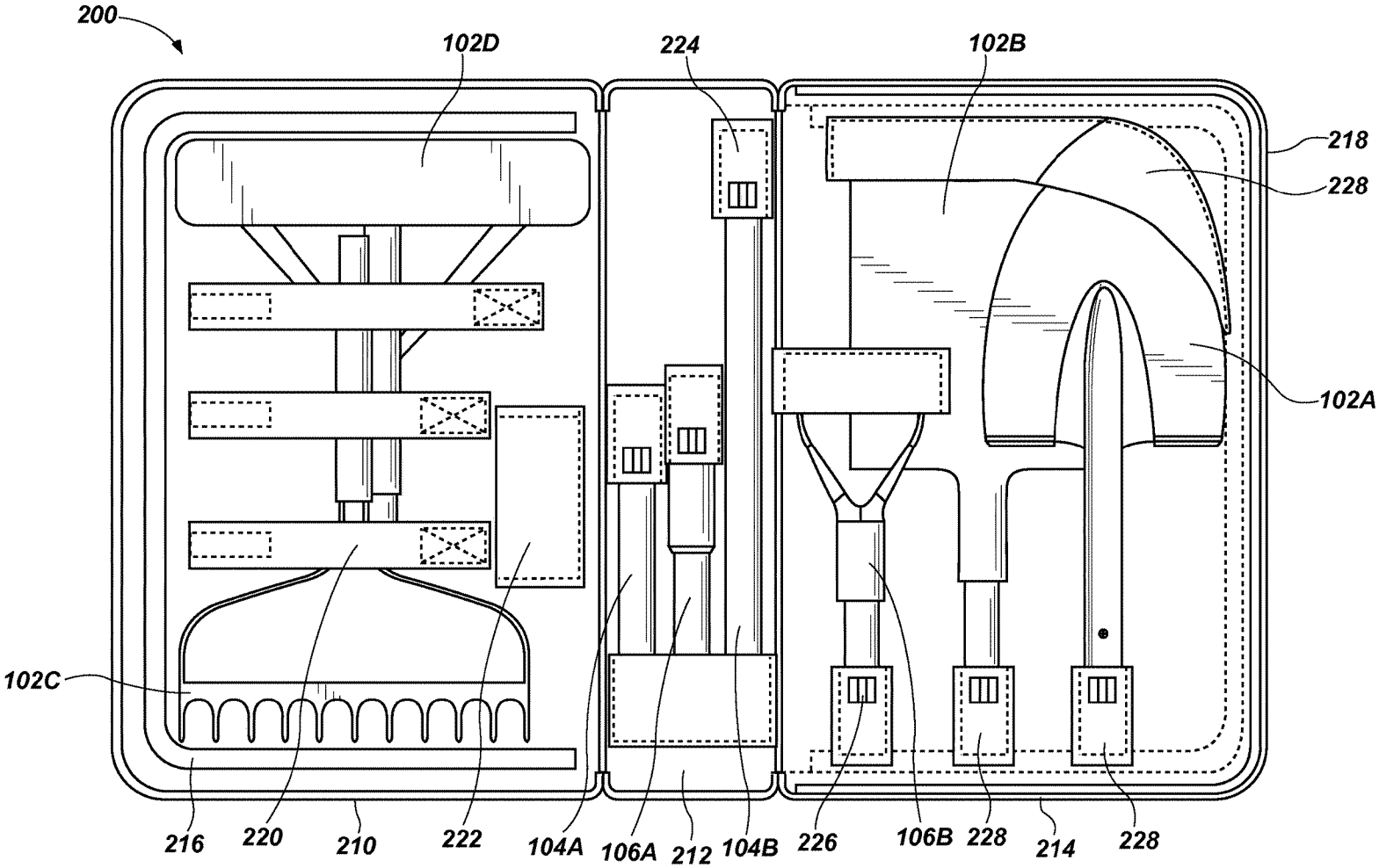
FIG. 10 is a top view of the carrying case shown in FIGS. 8A-8D in the open position.

Referring now to FIGS. 8A-10, the present disclosure may include a carrying system 200 for storing the outdoor tool system 100. The carrying system 200 may comprise a pair of flexible carrying handles 202. In an embodiment, the carrying system 200 may be configurable between a closed position as shown in FIGS. 8A-8D and an open position as shown in FIGS. 9 and 10. A pair of buckles 204 (FIG. 8A) may be utilized to secure the system 200 in the closed position.

The system 200 may include a first side panel 210, a middle panel 212, and a second side panel 214. The middle panel 212 may connect the first side panel 210 and the second side panel 214. The first side panel 210 and the middle panel 212 may be connected by a living hinge. The second side panel 214 and the middle panel 212 may also be connected by a living hinge.

As best seen in FIGS. 9 and 10, extending upwardly from the first side panel 210 may be a wall 216. The wall 216 may be three sided such that it does not extend along the portion nearest the middle side panel 212. Extending upwardly from the second side panel 214 may be a wall 218. The wall 218 may be three sided such that it does not extend along the portion nearest the middle side panel 212. The dimensions of the wall 218 may be just slightly larger than those of the wall 216 such that when the case 200 is moved to the closed position, the wall 216 may just fit inside of the perimeter of the wall 218.

Referring now to FIG. 10, the interior side of the first side panel 210 may include a storage location for the rake head 102C and the broom head 102D. The rake head 102C and the broom head 102D may be secured by straps 220. In particular, the straps 220 may be secured with hook and latch strip. The interior side of the first side panel 210 may include an accessories pocket 222.

The interior side of the middle panel 212 may include a storage location for the handle end 106A and the shaft segments 104A and 104B. Elastic pockets 224 may secure the handle end 106A and the shaft segments 104A and 104B to the middle panel 212.

The interior side of the second side panel 214 may include a storage location for the handle end 106B, the spade shovel head 102A, and the square shovel head 102B. The handle end 106B may be secured by elastic pockets 226. The tips of the spade shovel head 102A, and the square shovel head 102B may be secured by pockets 228.

Referring to FIGS. 8A-9, in an embodiment, the carrying system 200 may be dimensioned as indicated in Table 1.

TABLE 1

| Dimension | Length (inches) |
|---|---|
| a | 22"-28" or 24.25" |
| b | 4"-8" or 6" |
| c | 14"-20" or 16.5" |
| d | 14"-20" or 16" |
| e | 4"-8" or 5.75" |
| f | 14"-20" or 16.5" |
| g | 4"-8" or 5.5" |
| h | 14"-20" or 16.5" |
| i | 14"-20" or 15" |
| j | 3"-6" or 4" |
| k | .1"-.4" or .2" |
| l | .5"-1.5" or 1" |

In an embodiment, the carrying system 200 may be hard-sided or soft-sided case.

It will be appreciated that the structure and apparatus disclosed herein is merely one example of a means for connecting components of a tool system, and it should be appreciated that any structure, apparatus or system for connecting components of a tool system which performs functions the same as, or equivalent to, those disclosed herein are intended to fall within the scope of a means for connecting components of a tool system, including those structures, apparatus or systems for connecting components of a tool system which are presently known, or which may become available in the future. Anything which functions the same as, or equivalently to, a means for connecting components of a tool system falls within the scope of this element.

Those having ordinary skill in the relevant art will appreciate the advantages provided by the features of the present disclosure. For example, it is a feature of the present disclosure to provide a modular tool system that includes a plurality of components that may be configured in various configurations.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A hand tool comprising:

a first shaft segment defining a first socket;

a locking shaft extending through an interior of the first shaft segment;

a biasing member biasing said locking shaft;

a second shaft segment having an insertion tip configured for insertion into the first socket of the first shaft segment, said second shaft segment rotatable about a longitudinal axis between a locked position and an unlocked position in the first shaft segment; and a locking groove formed in the insertion tip of the second shaft segment;

wherein said locking shaft engages the locking groove when the second shaft segment is rotated to the locked position.

2. The hand tool of claim 1, further comprising a cam mechanism linking the second shaft segment to the first shaft segment, the cam mechanism comprising a curved slot and a pin, the cam mechanism operable to move the tip of the second shaft segment deeper into the first socket of the first shaft segment as the second shaft segment rotates from the unlocked position to the locked position.

3. The hand tool of claim 1, wherein the first shaft segment and the second shaft segment are differing lengths.

4. The hand tool of claim 1, wherein the first shaft segment and the second shaft segment are positioned end to end to form a handle assembly, the hand tool further comprising a tool head connected to the handle assembly, wherein the tool head is one of a spade shovel, a square shovel, a rake, and a broom.

5. The hand tool of claim 4, wherein the handle assembly comprises a handle end.

6. The hand tool of claim 5, wherein the handle end is one of a straight handle end and a D handle end.

7. The hand tool of claim 1, wherein the first shaft segment and the second shaft segment comprise wood.

8. The hand tool of claim 1, further comprising a handle end.

9. A hand tool comprising:

a tubular sleeve member defining a first socket and a second socket;

a first shaft segment having a tip installed into the first socket of the tubular sleeve member;

a second shaft segment having a tip configured for insertion into the second socket of the tubular sleeve member, said second shaft segment rotatable about a longitudinal axis between a locked position and an unlocked position in the tubular sleeve member;

a cam mechanism linking the second shaft segment to the tubular sleeve member, the cam mechanism operable to move the tip of the second shaft segment deeper into the second socket of the tubular sleeve member as the second shaft segment rotates from the unlocked position to the locked position;

wherein the first shaft segment and the second shaft segment are positioned end-to-end, without overlapping, to define a handle assembly when the second shaft segment is in the locked position in the tubular sleeve member;

a tool head connected to the handle assembly.

10. The hand tool of claim 9, wherein the cam mechanism comprises a cam surface formed in the tubular sleeve member and a pin extending from the second shaft segment.

11. The hand tool of claim 10, wherein the pin extends perpendicularly to the longitudinal axis.

12. The hand tool of claim 11, wherein the pin slides along the cam surface as the second shaft segment rotates between the unlocked position and the locked position.

13. The hand tool of claim 9, wherein the tool head is removably attachable to handle assembly.

14. The hand tool of claim 9, wherein the first shaft segment and the second shaft segment are differing lengths.

15. The hand tool of claim 9, wherein the tool head is one of a spade shovel, a square shovel, a rake, and a broom.

16. The hand tool of claim 9, wherein the handle assembly comprises a grip.

17. The hand tool of claim 16, wherein the handle assembly is one of a straight grip and a D grip.

18. The hand tool of claim 9, wherein the first shaft segment and the second shaft segment comprise wood.

19. The hand tool of claim 9, wherein the cam mechanism comprises a curved slot and a pin.

20. The hand tool of claim 19, wherein the cam mechanism is operable to guide the second shaft segment between the locked position and the unlocked position.

21. A hand tool comprising:

a tubular sleeve member defining a first socket and a second socket;

a pair of elongated slots formed in the tubular sleeve member;

a locking shaft disposed in the elongated slots;

a biasing member biasing said locking shaft;

a first shaft segment having a tip installed into the first socket of the tubular sleeve member;

a second shaft segment having an insertion tip configured for insertion into the second socket of the tubular sleeve member, said second shaft segment rotatable about a longitudinal axis between a locked position and an unlocked position in the tubular sleeve member;

a locking groove formed in the tip of the second shaft segment;

wherein said locking shaft engages the locking groove when the second shaft segment is rotated to the locked position;

wherein the first shaft segment and the second shaft segment are positioned end-to-end to define a handle assembly when the second shaft member is in the locked position; and a tool head connected to the handle assembly.

22. The hand tool of claim 21, further comprising a release button, wherein said release button disengages the locking shaft from the locking groove when activated to allow the second shaft segment to rotate from the locked position to the unlocked position.

23. The hand tool of claim 21, wherein the tool head is removably attachable to the handle assembly.

24. The hand tool of claim 21, wherein the first shaft segment and the second shaft segment are differing lengths.

25. The hand tool of claim 21, wherein the tool head is one of a spade shovel, a square shovel, a rake, and a broom.

26. The hand tool of claim 21, wherein the handle assembly comprises a grip.

27. The hand tool of claim 26, wherein the grip is one of a straight grip and a D grip.

28. The hand tool of claim 21, wherein the first shaft segment and the second shaft segment comprise wood.

29. A hand tool kit comprising:

a plurality of tool heads;

a plurality of shaft segments;

each of the plurality of shaft segments having an insertion tip at a first end, a connector at a second end, and a locking groove;

wherein each connector is adapted to connect its shaft segment to any other one of the shaft segments;

wherein each connector comprises:

a tubular sleeve member defining a first socket adapted to receive the insertion tip of any other one of the plurality of shaft segments, a pair of elongated slots formed in the tubular sleeve member, a locking shaft disposed in the pair of elongated slots and extending laterally across the first socket, the locking shaft adapted to engage the locking groove of any other one of the shaft segments, and a resilient member operable to bias said locking shaft against the locking groove;

wherein any one of the plurality of tool heads is selectively attachable to a handle assembly formed from one or more of the plurality of shaft segments.

30. The hand tool kit of claim 29, wherein each of the plurality of tool heads comprises an insertion tip and a locking groove, and wherein each connector is further operable to connect its shaft segment to any one of the tool heads.

31. The hand tool kit of claim 29, wherein each insertion tip comprises a pin extending laterally therefrom, wherein each connector comprises a cam surface, and wherein said pin and cam surface are adapted to translate a rotation of an insertion tip into a linear movement between a locked position and an unlocked position.

32. The hand tool kit of claim 29, wherein each connector further comprises a manual release button operable to disengage its locking shaft from a locking groove such that a pair of coupled shaft segments can be uncoupled.

33. The hand tool kit of claim 32, wherein the manual release button is disposed on one of or both ends of the locking shaft.

34. The hand tool kit of claim 29, wherein the plurality of shaft segments comprises a first shaft segment and a second shaft segment, wherein the first shaft segment and the second shaft segment differ in length.

35. The hand tool kit of claim 29, wherein the plurality of tool heads comprises at least two of a spade shovel, a square shovel, a rake, and a broom.

36. The hand tool kit of claim 29, wherein the plurality of tool heads comprises at least three of a spade shovel, a square shovel, a rake, and a broom.

37. The hand tool kit of claim 29, wherein the plurality of tool heads comprises a spade shovel, a square shovel, a rake, and a broom.

38. The hand tool kit of claim 29, wherein each of the plurality of shaft segments comprises wood.

39. The hand tool kit of claim 29, further comprising a plurality of handles, each of the plurality of handles comprising a handle connector adapted to connect its handle and any one of the plurality of shaft segments.

40. The hand tool kit of claim 39, wherein each handle connector comprises:

a tubular sleeve member defining a first socket adapted to receive an insertion tip of any one of the plurality of segments;

a pair of elongated slots formed in the tubular sleeve member;

a locking shaft disposed in the pair of elongated slots and extending laterally across the first socket;

the locking shaft adapted to engage a locking groove of any one of the plurality of segments; and a resilient member operable to bias said locking shaft in the locking groove.

41. The hand tool kit of claim 39, wherein each handle assembly comprises a grip.

42. The hand tool kit of claim 41, wherein the grip is one of a straight grip and a D grip.

43. An apparatus comprising:

a tubular sleeve member defining a first socket;

a pair of elongated slots formed in the tubular sleeve member;

a locking shaft disposed in the elongated slots;

a biasing member biasing said locking shaft;

a first component having an insertion tip configured for insertion into the first socket of the tubular sleeve member, said first component rotatable about a longitudinal axis between a locked position and an unlocked position in the tubular sleeve member; and a locking groove formed in the insertion tip of the first component;

wherein said locking shaft engages the locking groove when the first component is rotated to the locked position.

44. A hand tool kit comprising:

a plurality of tool heads, each of the plurality of tool heads comprising an insertion tip, a locking groove, and a pin extending laterally therefrom, wherein the plurality of tool heads comprises a spade shovel, a square shovel, a rake, and a broom;

a plurality of handle ends, each of the handle ends having a grip at a first end and a connector at a second end, wherein the plurality of handle ends comprises a straight grip and a D grip;

a plurality of shaft segments, each of the plurality of shaft segments having an insertion tip at a first end, a connector at a second end, a locking groove, and a pin extending laterally therefrom;

wherein the plurality of shaft segments comprises a first shaft segment and a second shaft segment, wherein the first shaft segment and the second shaft segment differ in length;

wherein each of the plurality of shaft segments comprises wood;

wherein each connector of the handle ends and the plurality of shaft segments is adapted to connect its handle end or shaft segment to any other one of the shaft segments or any one of the tool heads;

wherein each connector comprises:

a tubular sleeve member defining a first socket adapted to receive an insertion tip, a cam surface formed in the tubular sleeve member, the cam surface interacting with a pin to translate a rotation of the insertion tip into a linear movement, a pair of elongated slots formed in the tubular sleeve member, a locking shaft disposed in the pair of elongated slots and extending laterally across the first socket, the locking shaft adapted to engage a locking groove, a manual release button operable to disengage the locking shaft from the locking groove, and a resilient member operable to bias said locking shaft against the locking groove.

* * * * *